US007395994B1

(12) United States Patent
Sikra

(10) Patent No.: US 7,395,994 B1
(45) Date of Patent: Jul. 8, 2008

(54) QUICK RELEASE PERCUSSION INSTRUMENT ARM ADAPTER

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 395 days.

(21) Appl. No.: 10/966,439

(22) Filed: Oct. 18, 2004

(51) Int. Cl.
*A47B 96/06* (2006.01)
*A47F 5/00* (2006.01)

(52) U.S. Cl. ..... 248/229.1; 248/229.13; 248/230.1; 248/125.1; 84/421

(58) Field of Classification Search ..... 248/316.1, 248/230.1, 230.4, 239.9, 523, 231.21, 231.51; 84/421, 422.3
See application file for complete search history.

(56) References Cited

U.S. PATENT DOCUMENTS

| | | | | |
|---|---|---|---|---|
| 1,547,065 | A * | 7/1925 | Noble | 248/229.13 |
| 3,706,437 | A * | 12/1972 | Eberhardt | 248/230.4 |
| 4,225,104 | A * | 9/1980 | Larson | 248/125.8 |
| 5,878,840 | A * | 3/1999 | Tessum et al. | 182/229 |
| 5,931,257 | A * | 8/1999 | Harden | 182/92 |
| 5,936,176 | A | 8/1999 | Lombardi | |
| 6,015,128 | A | 1/2000 | Lombardi | |
| 6,096,956 | A * | 8/2000 | Hoshino | 84/421 |
| 6,259,011 | B1 * | 7/2001 | Liao | 84/421 |
| 6,585,206 | B2 * | 7/2003 | Metz et al. | 248/229.1 |
| 7,157,636 | B2 * | 1/2007 | Hsieh | 84/387 R |

* cited by examiner

*Primary Examiner*—Amy J. Sterling
*Assistant Examiner*—Tan Le
(74) *Attorney, Agent, or Firm*—William W. Haefliger

(57) ABSTRACT

A percussion instrument arm adapter, comprising in combination, a support at one end of an arm, the support including rod clamping elements positioned for relative adjustment to clamp a rod, structure for effecting the relative adjustment, one of the elements swingable relatively away from the other element when at least part of the structure is moved out of element adjusting position, and against a shoulder or shoulders resisting such movement.

12 Claims, 10 Drawing Sheets

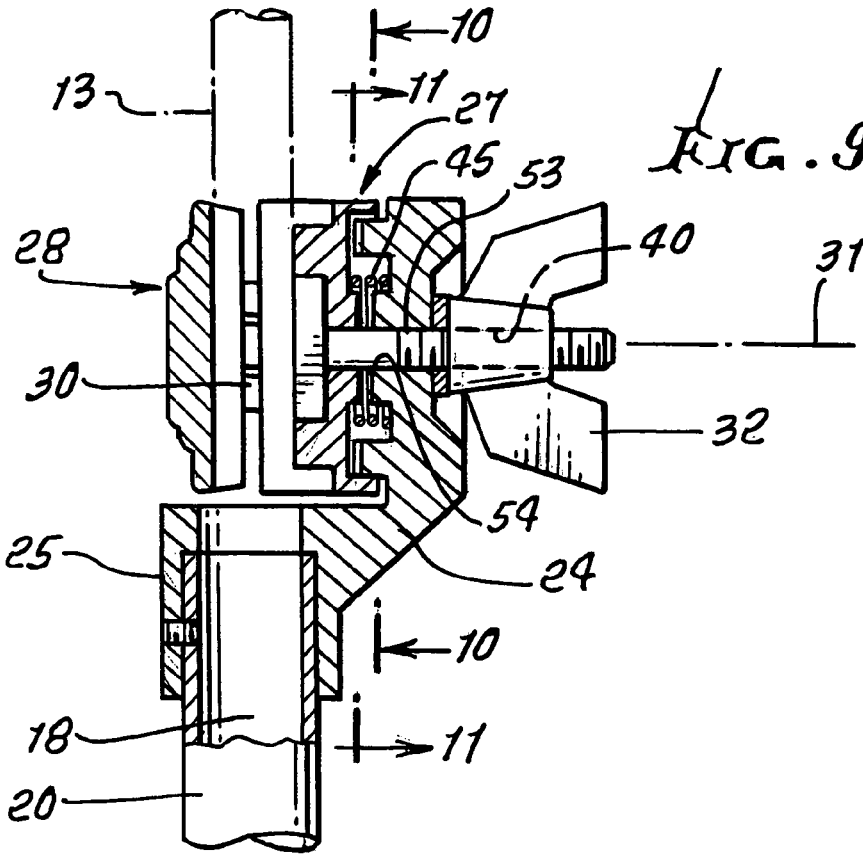
FIG. 9.
FIG. 10.
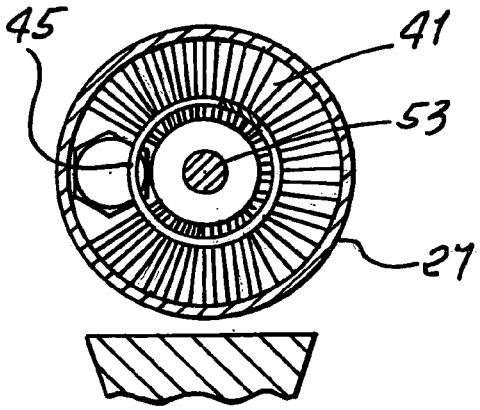
FIG. 11.
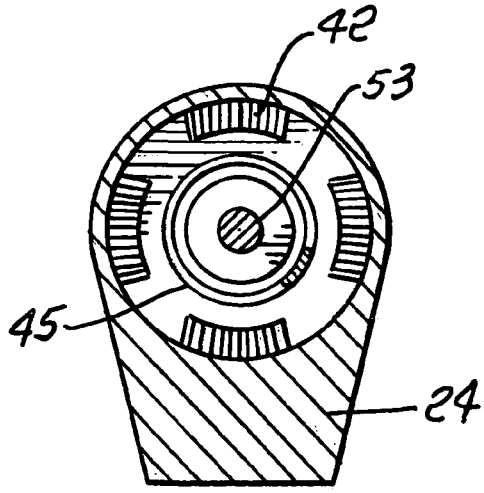

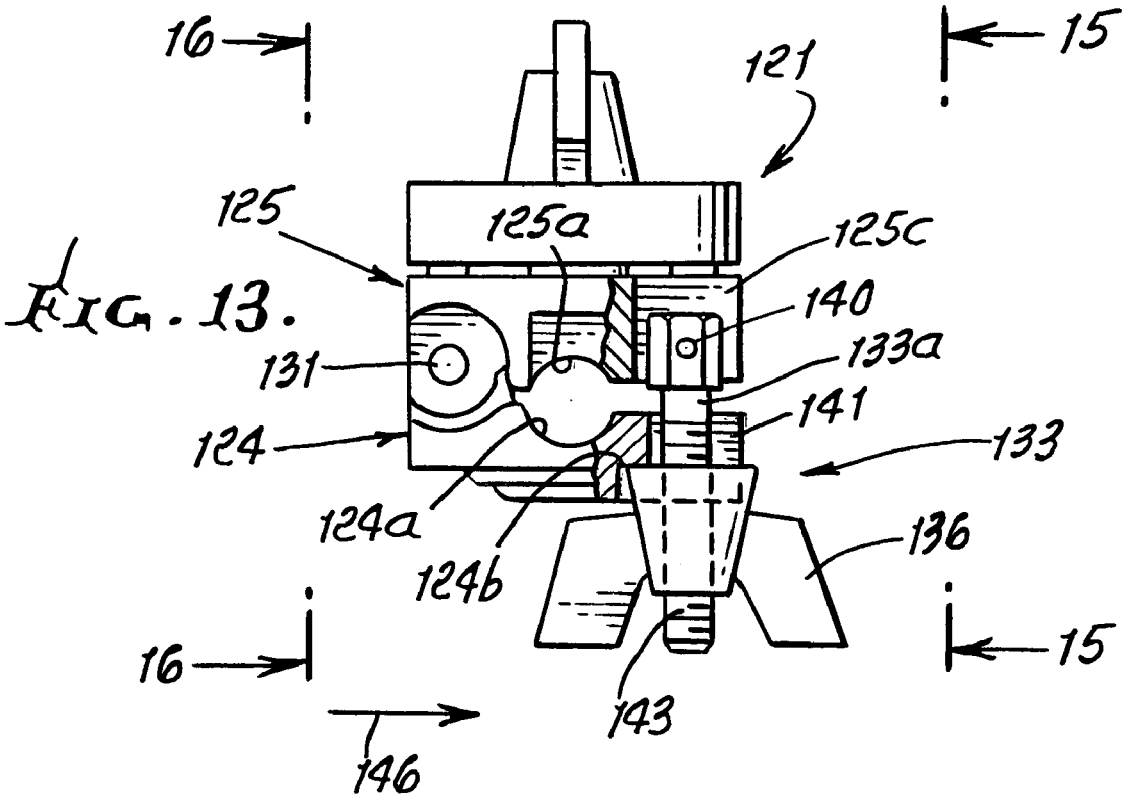
FIG. 13.
FIG. 14.
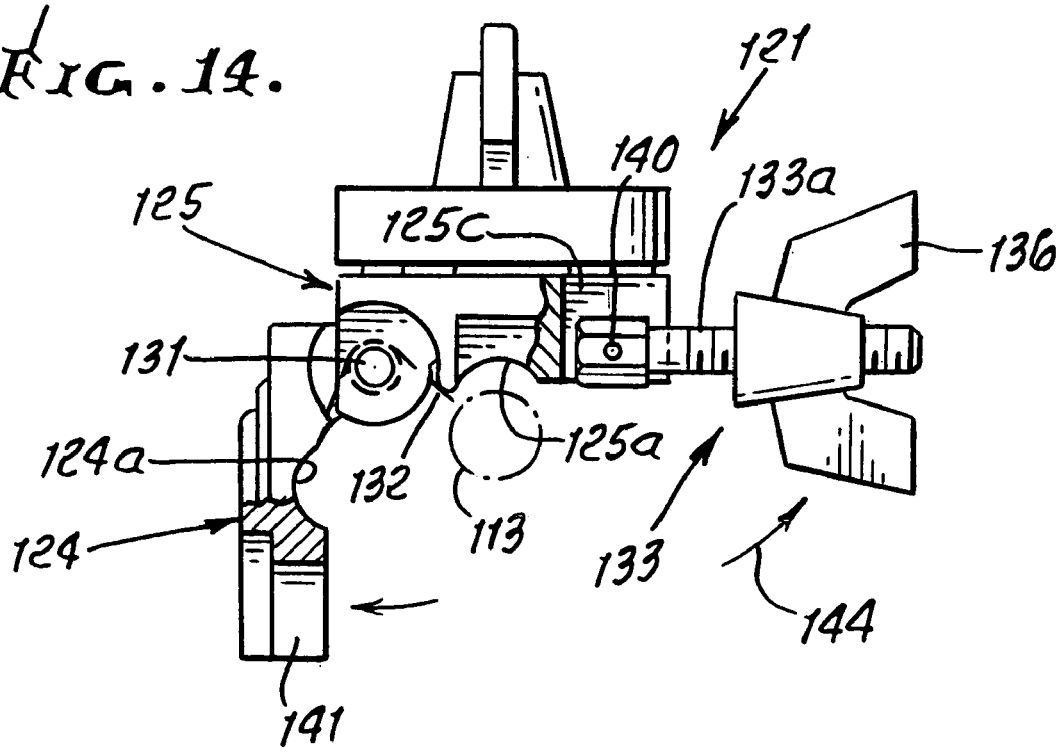

FIG. 18.
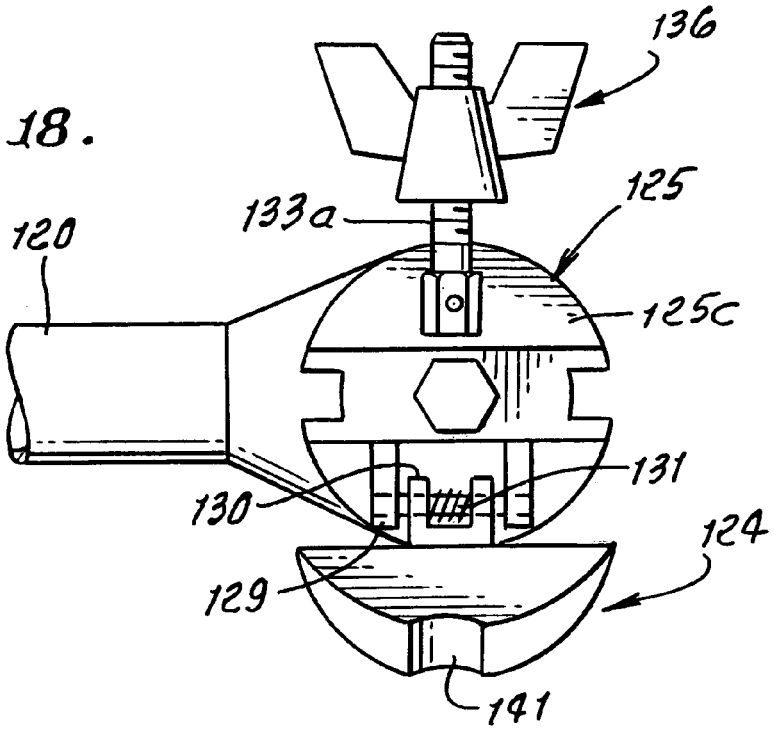
FIG. 19.
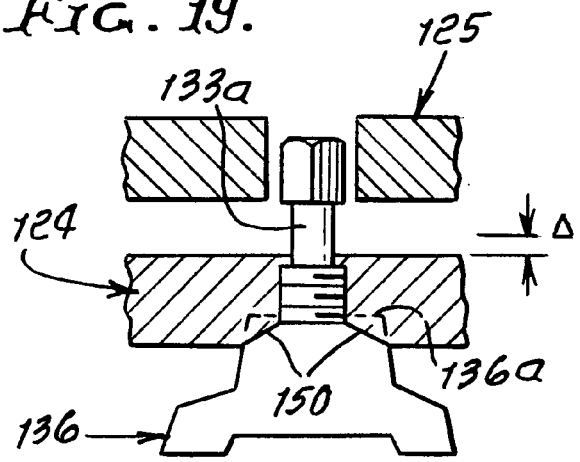
FIG. 21.
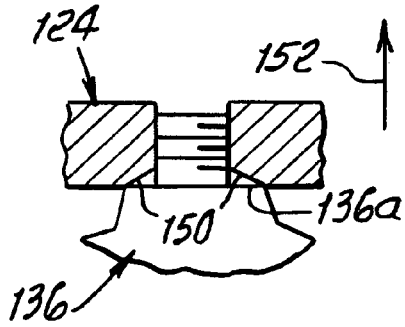
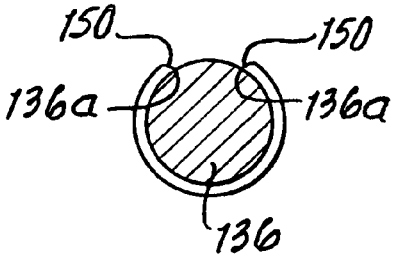
FIG. 20.

QUICK RELEASE PERCUSSION INSTRUMENT ARM ADAPTER

BACKGROUND OF THE INVENTION

This invention relates generally to percussion instrument support mechanisms; and more particularly to an improved, readily and easily installable percussion instrument arm adapter. Percussion instruments such as cymbals and drums are frequently mounted on linkage mechanisms in the form of arms that interconnect at multiple points. There is continual need for improved mechanisms, which are readily and easily interconnectable by musicians, so as not to loosen or otherwise deteriorate in use, often times involving heavy and frequent impacting of the instruments. So far as I am aware, no prior arm adapter incorporates the unusually advantageous structure, functioning and highly advantageous results as are now incorporated in the herein described arm adapter.

This invention constitutes an improvement upon the adapter disclosed in U.S. Pat. No. 5,936,176, incorporated herein by reference.

SUMMARY OF THE INVENTION

It is a major object of the invention to provide an unusually effective improved percussion instrument arm adapter, having multiple advantages as will appear.

Basically the device comprises a) a support at one end of one arm, the support including rod clamping elements positioned for relative adjustment to clamp a rod, b) structure for effecting said relative adjustment, c) one of the elements swingable relatively away from the other element when at least part of said structure is moved out of element adjusting position, and against a shoulder resisting such movement.

It is another object of the invention to provide a first hinge operatively connected with the one element to allow swinging thereof toward and away from the other element; and a second hinge operatively connected with said structure to allow movement of said part out of element adjusting position.

A further object is to provide for interengaged relation between said part and the one element, prior to movement of said part out of element adjusting relation; said part including a fastener, and an adjusting nut engaging the fastener shaft and projecting away from the one element in adjusting position.

A yet further object is to provide a quick disconnect as between the part and the one element, easily effected by manual pressure on the adjusting nut. That connection may be provided by hinging of the fastener, to be swingable away from the one element, in the form of a rod clamping element.

A yet additional object includes provision of an adapter arm comprising a) the arm having a support at each end thereof the support including rod clamping elements positioned for relative adjustment to clamp a rod, b) structure for effecting said relative adjustment, c) one of the elements swingable relatively away from the other element when at least part of such structure is moved out of element adjusting position, and against a shoulder resisting such movement.

First and second hinges may be provided as at each end of the arm, allowing quick disconnect of the arm from rods clamped by the supports.

An additional object is to provide a spring exerting force tending to swing the one element away from the other element. As will appear, the spring is preferably mounted in association with the hinge; and the shoulder is on the one element and extends in the path of spring urged movement of said one part, to captivate the one part in clamp adjusting position; and, that shoulder is preferably configured to urge the one element temporarily and yieldably toward the other element, against spring exerted pressure, as the one part overrides the shoulder upon being initially moved in a direction to carry said one part out of rod clamping position, i.e. to disengage the two elements, with snap-open clam-shell release. Need for clamping releasing rotation of the wing nut is thereby obviated.

These and other objects and advantages of the invention, as well as the details of an illustrative embodiment, will be more fully understood from the following specification and drawings, in which:

DRAWING DESCRIPTION

FIG. 9 is a section taken on lines 9-9 of FIG. 6;

FIG. 10 is a section taken on lines 10-10 of FIG. 9;

FIG. 11 is a section taken on lines 11-11 of FIG. 9;

FIG. 13 is a view like FIG. 8, but showing an improvement modification;

FIG. 14 is a view like FIG. 13, but showing quick disconnect of the device, and release of a rod;

FIG. 18 is a view looking at the device after relative movement of elements into completely released position;

FIG. 19 is a fragmentary side view showing captivation of an adjuster by a shoulder on one element;

FIG. 20 is a fragmentary plan view showing adjuster captivation; and

FIG. 21 is a view like FIG. 19, but showing over-riding of the shoulder by the adjuster and associated temporary deflection of the one element toward the other element, prior to relative quick-release spread apart of the elements.

DETAILED DESCRIPTION

Figure 1:
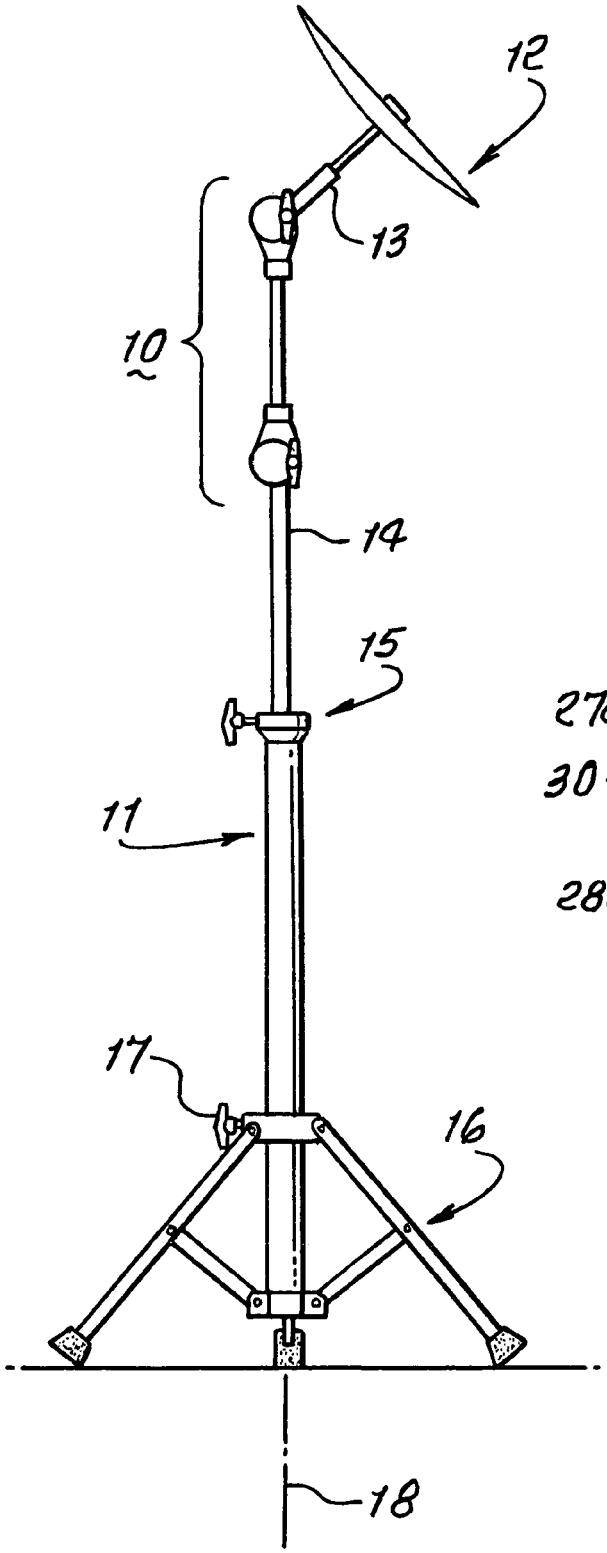
FIG. 1 is an elevation showing the arm adapter installed in a cymbal support apparatus.

FIGS. 1-12 are shown in the above referenced U.S. Pat. No. 5,936,176, and are included and incorporated herein for references, as follows:

In the drawings, a percussion instrument arm adapter is shown at 10. In FIG. 1, it is integrated into an upright stand 11 for a cymbal 12 carried by an upper rod 13. A lower rod 14 supports the adapter 10, and is carried by lengthwise vertically adjustable mechanism 15 supported by legs 16. Loosening of a set screw 17 allows leg collapse toward vertical axis 18.

Figure 2:
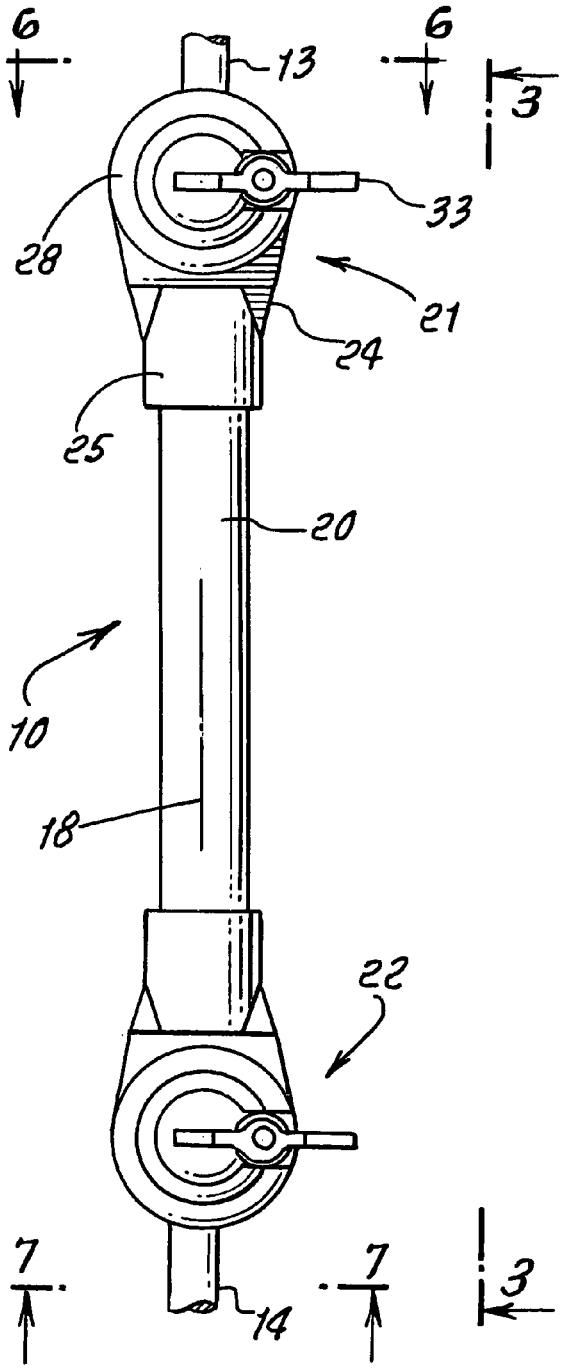
FIG. 2 is a front elevation of the arm adapter shown in an enlarged form.
Figure 3:
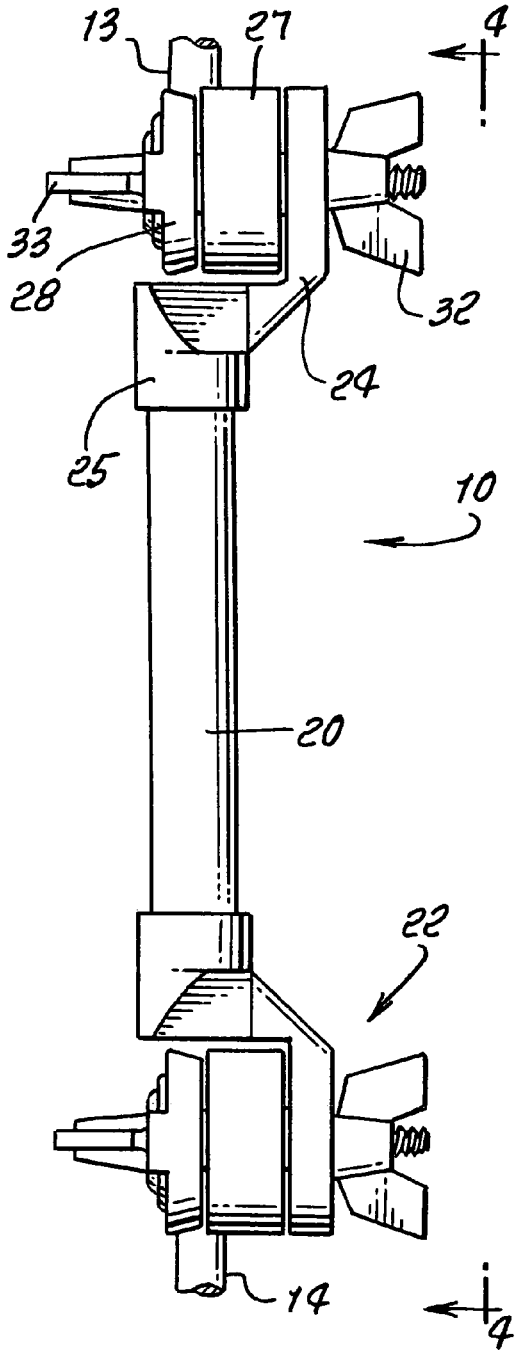
FIG. 3 is a side elevation taken on lines 3-3 of FIG. 2.
Figure 4:
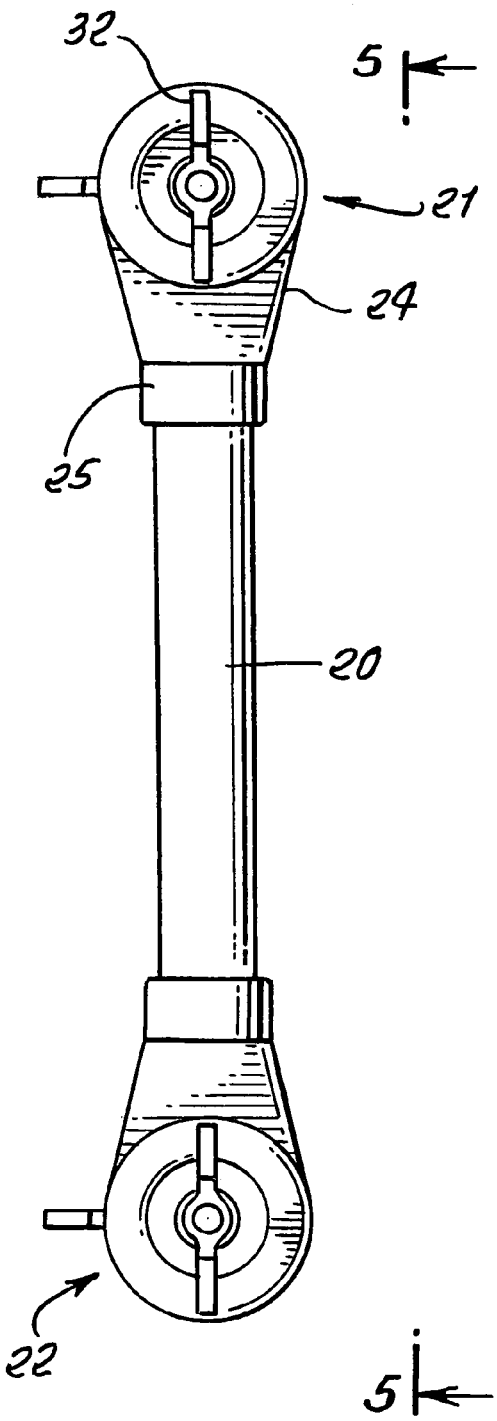
FIG. 4 is a rear elevation taken on lines 4-4 of FIG. 3.
Figure 5:
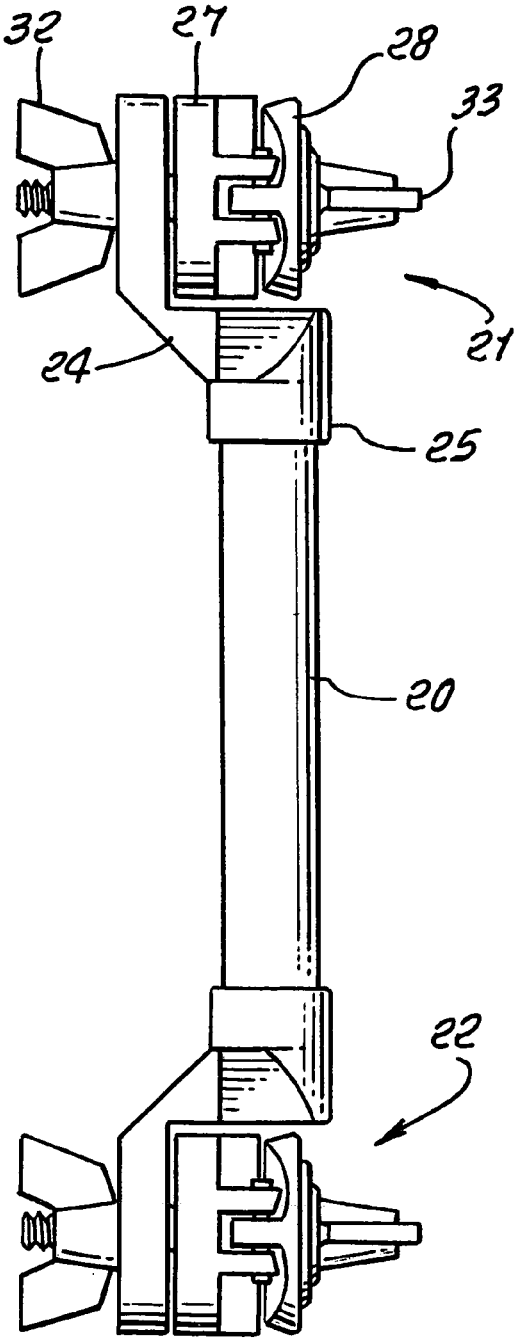
FIG. 5 is a left side elevation taken on lines 5-5 of FIG. 4.

Turning to FIGS. 2 and 3, the adapter 10 includes a longitudinally extending arm 20, a first clamp unit 21 carried at one end of the arm (for example to clamp rod 13), and a second clamp unit 22 carried at the opposite end of the arm (for example to clamp rod 14).

At least one of the units, and preferably each of the units 21 and 22 has elements including a carrier, a primary clamping plate and a secondary clamping plate, a primary fastener interconnecting the carrier and first clamp plate to laterally retain the primary clamping plate to the carrier, and a secondary fastener adjustably interconnecting the second clamp plate and first clamp plate, those plates defining rod receiving or clamping surfaces.

Figure 6:
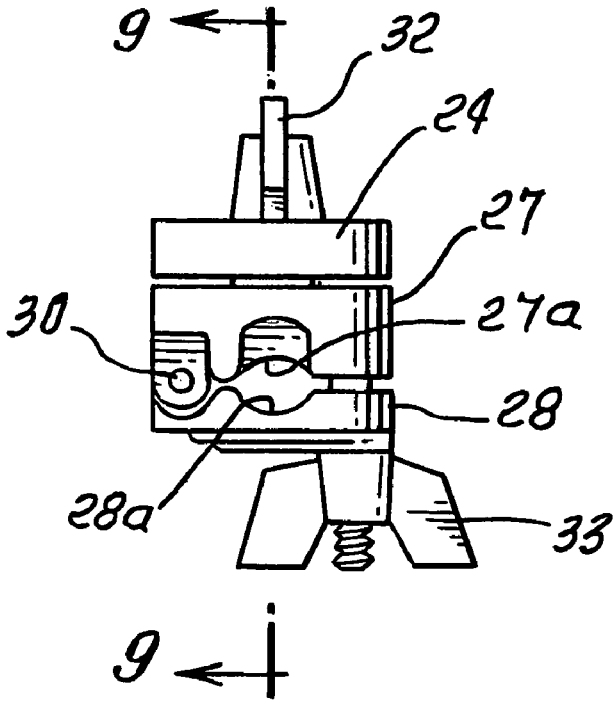
FIG. 6 is a top plan view taken on lines 6-6 of FIG. 2.
Figure 7:
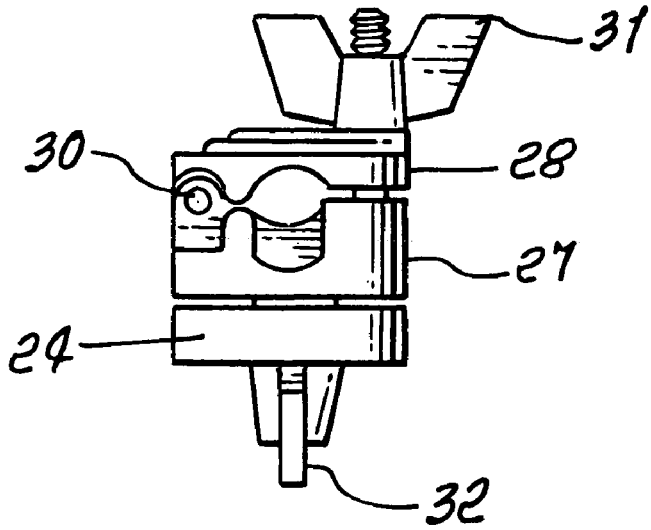
FIG. 7 is a bottom plan view taken on lines 7-7 of FIG. 2.

In the example, the upper unit carrier 24 is non-rotatable, it maybe integral with a support body 25, which is integral with or attached to arm 20, and it is shown in FIG. 9 as offset laterally from a longitudinal axis 26 defined by arm 20. A primary clamping element such as a plate is seen at 27 as carried by the carrier 24, and a secondary clamping element such as a plate is seen at 28 as carried by the element 27. As seen in FIGS. 6 and 9, the two plates are interconnected as by a hinge 30 offset from a lateral axis 31.

The two plates are adjustably rotatable as a unit about axis 31 to a desired rod clamping position (allowing tilt angle adjustment of the cymbals) and a primary fastener including a wing nut 32 is then tightened, to clamp plate 27 to the carrier 24, preventing further rotation about axis 31. Axis 31 intersects axis 18. The two plates are then adjustably clamped toward one another and a second fastener including a wing nut 33 is then tightened, to clamp the inner concave surfaces 27*a* and 28*a* of the plates against opposite sides of the rod 13. See FIG. 8. The secondary fastener defines an axis 38 of wing nut 33 rotation, offset from lateral axis 31, and the hinge 30 and axis 38 are at opposite sides of lateral axis 31, providing a very compact, sturdy arrangement or combination of components at the upper clamp unit. Axis 31 is the axis of wing nut 32 rotation. Note fastener rod 50 in FIG. 8, carried by plate 27 to project through enlarged bore 51 in plate 28 for threadably receiving wing nut 33 threads. Nut 33 tightens on surface 28*a* of plate 28. Spring 52 urges plates 27 and 28 apart.

FIGS. 9-11 show a threaded rod 53 integral with plate 27 and projecting laterally along axis 31 through bore 54 in 24 and into a threaded bore 40 defined by the wing nut 32. As the nut is rotatably tightened, it draws the plate 27 rightwardly in FIG. 9 toward carrier 24, whereby teeth 41 and 42 on the plate and carrier interengage to block rotation of plate 27 about axis 31. A compression spring 45 extending between 24 and 27 urges plate 27 leftwardly.

The configuration described and shown allows the rod clamping surfaces 27*a* and 28*a* of the two plates to be located generally in alignment with the axis of the arm 20, to enhance adjustability.

The lower unit 22 and the lower end of the arm 20 embody the same or similar components as described for the upper unit, and such corresponding upper and lower unit components have the same identifying numbers.

Figure 8:
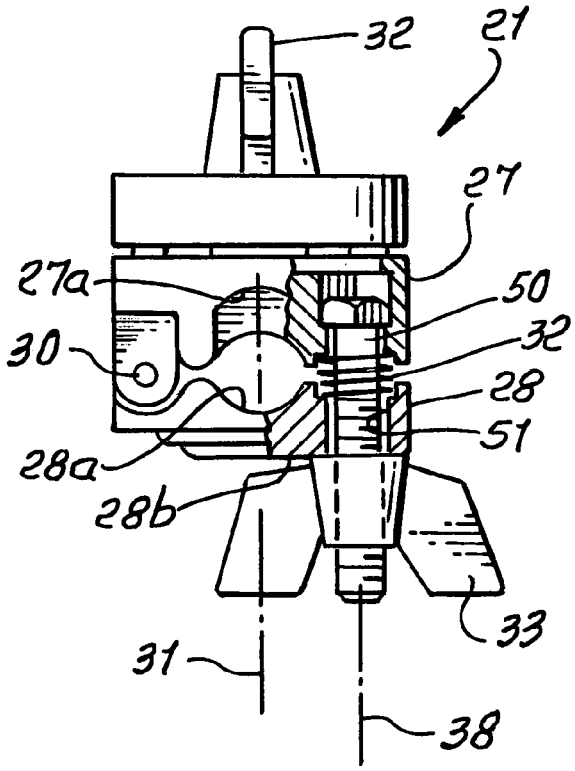
FIG. 8 is an enlarged view like FIG. 6, but broken away to show clamping mechanism.

Plates 27 and 28, and carrier 24 are generally cylindrical, as shown, and define a common lateral axis 31. As seen in FIG. 8 the wing nuts 32 and 33 are at laterally opposite sides of the unit 21, but their laterally extending axes of rotation are offset, enhancing compactness.

Figure 12:
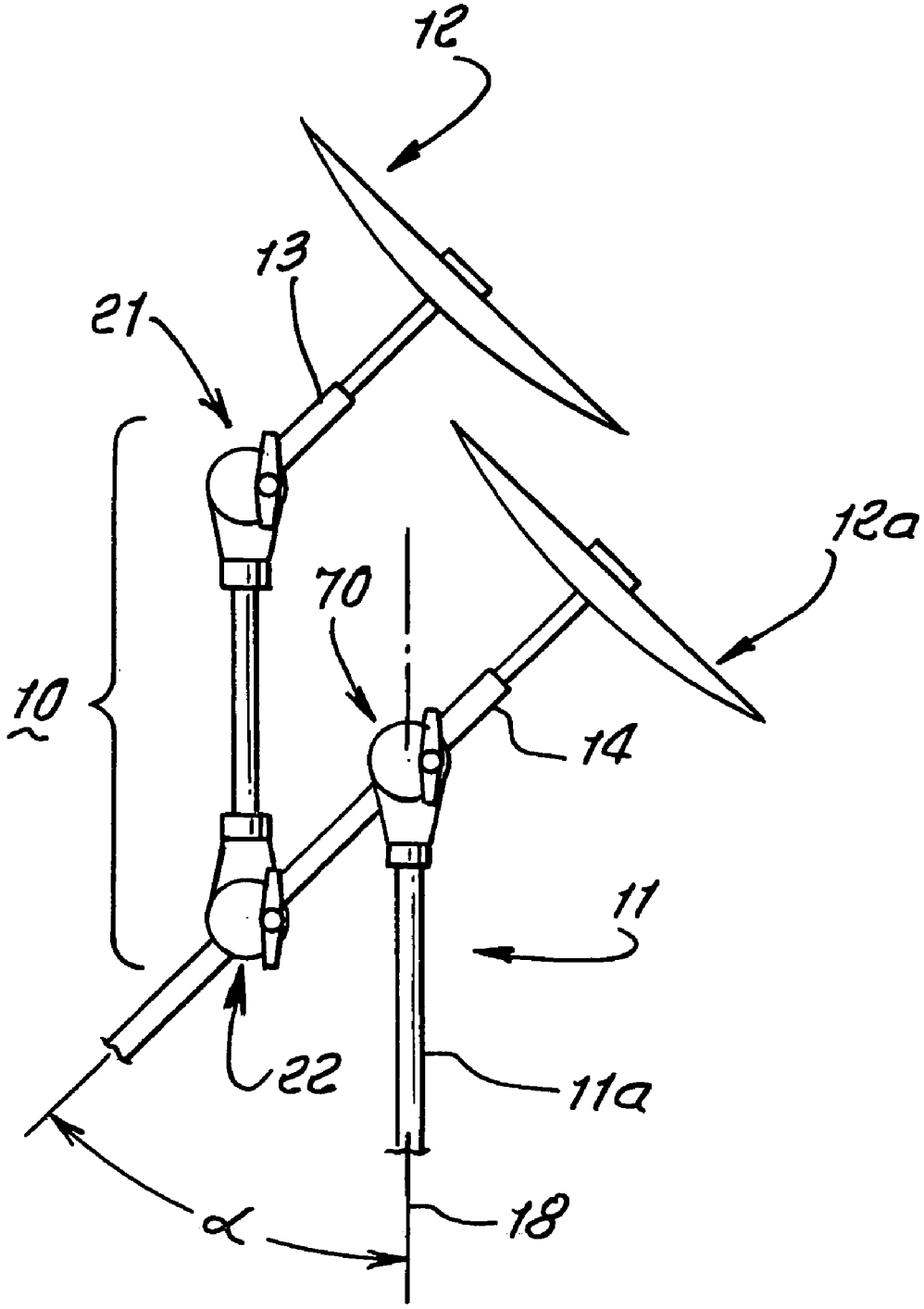
FIG. 12 is a view like FIG. 1, showing a modification.
Figure 15:
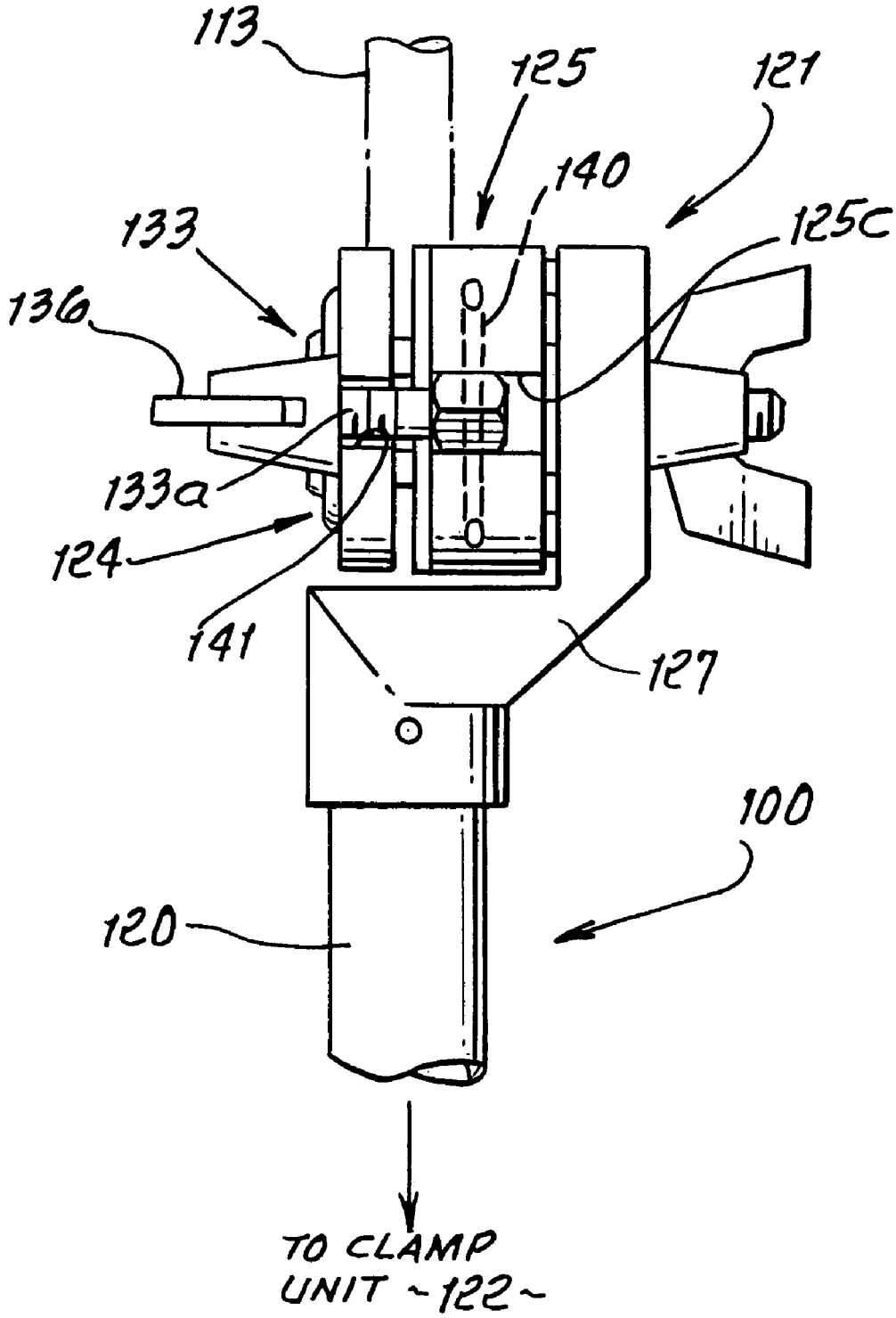
FIG. 15 is an elevation taken on lines 15-15 of FIG. 13.
Figure 16:
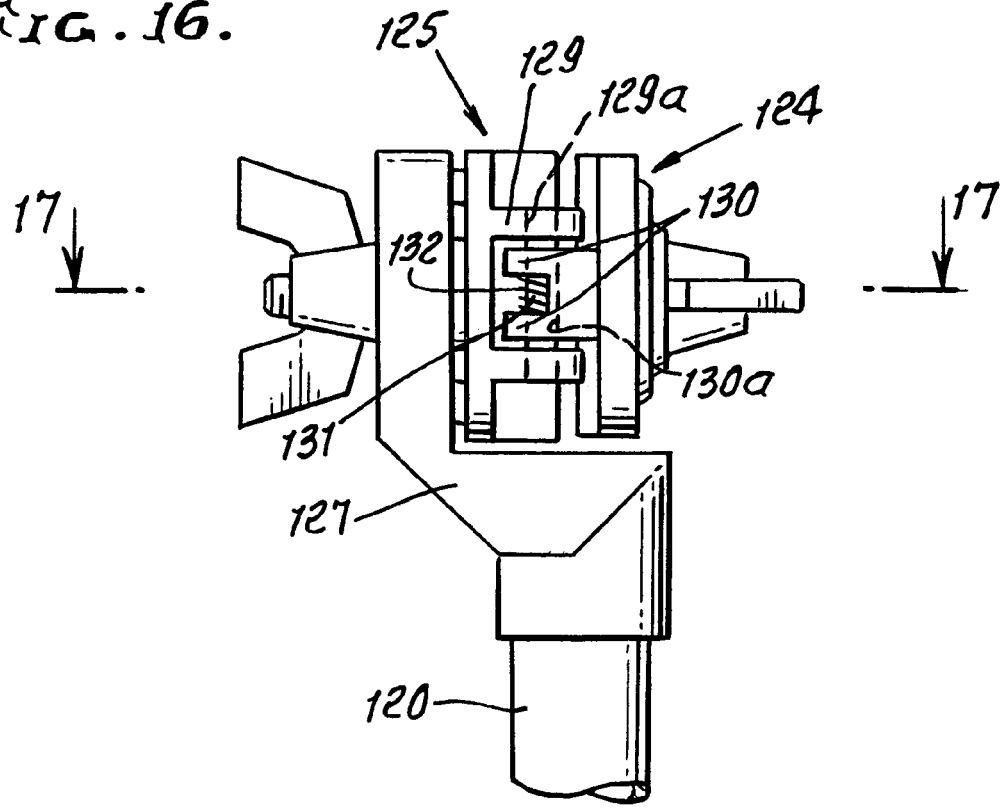
FIG. 16 is an elevation taken on lines 16-16 of FIG. 13.
Figure 17:
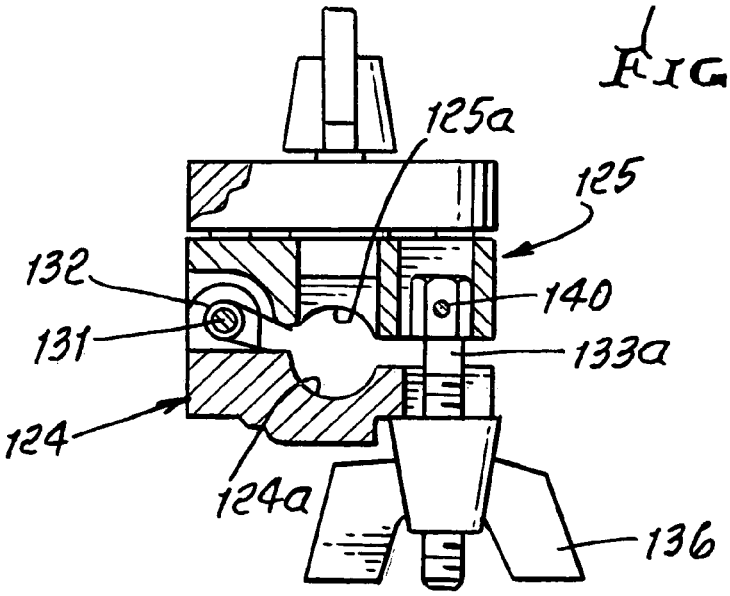
FIG. 17 is a section taken on lines 17-17 of FIG. 16.

In FIG. 12, the cymbal stand component 11*a* (as also seen in FIG. 1) supports the adapter 10 to extend in offset relation to the upright axis 18. One rod 14 is clamped by the lower clamping unit 22 of the adapter and is also supported by head 70 at the top of the cymbal stand 11. Head 70 may have the same $\alpha$ construction as unit 21 or 22. Thus rod 14 may be clamped by both 70 and 22, to extend at angle $\alpha$ relative to axis 18. A cymbal 12*a* may be carried by rod 14, as shown. Another cymbal 12 may be carried by rod 13, also extending at an angle relative to axis 18. Rods 13 and 14 may extend in parallel relation.

DESCRIPTION OF PREFERRED EMBODIMENT

In FIGS. 13-21, a percussion instrument arm adapter comprises, in combination:

a) a support at one end of one arm, the support including rod clamping elements positioned for relative adjustment to clamp a rod, b) structure for effecting such relative adjustment, c) one of the elements swingable relatively away from the other element when at least part of the structure is moved out of element adjusting position, and against a shoulder resisting such movement.

More specifically, the illustrated embodiment (of which different forms may be provided within the scope of the invention) includes an adapter 100 corresponding to adapter 10 as referred to above. The adapter includes a longitudinally extending arm 120, a first clamp unit 121 carried at one end of the arm to clamp a rod 113; and a second clamp unit 122 carried at the opposite end of the arm to clamp a rod. Units 121 and 122 may be alike, or substantially alike.

At least one of the units includes a support providing two clamping elements positioned for relative adjustment to clamp a rod; structure for effecting such relative adjustment; one of the elements swingable relatively away from the other element when at least part of that structure is moved out of element adjusting position, and against a shoulder resisting such movement.

In the example, unit 121 includes two elements 124 and 125 forming arcuate recesses 124*a* and 125*a* for reception of a rod 113 to be clamped by those elements. One of the elements, 124, is carried to be swingable relatively away from the other element, as seen in FIG. 14, to release the rod. Element 125 is integral with carrier 127 attached to arm 120; and element 124 is hinged to element 125, to swing toward and away from 125, as in a clam shell mode. See in FIG. 16 hinge projections 129 integral with 125, hinge projections 130 integral with 124, and hinge pin 131 extending into or through aligned openings 129*a* and 130*a* in 129 and 130. A coil spring 132 wrapped about the pin urges the element 124 in a opening direction, i.e. away from element 125, as seen in FIG. 14. Projections 129 and 130 are sidewardly offset from the recesses 124*a* and 125*a*. Elements 124 and 125 have generally circular peripheries.

Structure 133 is provided for effecting relative adjustment of the elements 124 and 125 to clamp the rod; and also for allowing element 124 to swing away from, i.e. to open away from element 125, when at least part of the structure 133 is moved out of element adjusting position, and against a shoulder resisting such movement. Also, such movement, typically swinging of structure as seen in FIG. 14, obviates need to change the adjusting movement of such structure, as in FIG. 13 position, to effect unclamping release of the rod (as by rotation of a wing nut 136 in loosening direction.

Note in FIGS. 13 and 14 that structure 133 may advantageously include an elongated fastener 133*a* hinge connected at 140 to element 125, in and slot 125*c* to swing into a slot 141 in element 124 so that wing nut 136 may then be rotated to effect clamping of the elements 124 and 125 against the rod. Nut 136 in FIG. 13 bears against surface 124*b* of element 124, to effect such clamping when the nut is rotated on thread 143 of the fastener. Arrow 144 indicates the direction of swinging movement of the fastener 133*a* to release element 124, to be quickly rotatably moved away from element 125, by spring tension, i.e. with clam shell snap open release.

Hinge connection 140 may be regarded as a second hinge, and hinge connection provided at 129 and 130 may be regarded as a first hinge. Fastener 133*a* received in slot 141 may be regarded as providing a tongue and groove connection. Large wing nut 136 is shown as projecting away from the one element 124 in the adjusting position of FIG. 1, for ease of quick manual pushing impact against the nut, in a striking direction indicated by arrow 146, and effect rightward decoupling of 133 and 124 to enable quick clam-shell opening of 124 and 125, and release of the rod, as in FIG. 14.

A shoulder 150 or shoulders on 124 seen in FIG. 20 normally resists such rightward swinging movement of the fastener 133*a* to prevent inadvertent release of 124 from 125; and the fastener 133*a* is configured and adapted to travel past that shoulder when forcibly struck in the direction of arrow 146, to allow release swinging of the fastener. Fastener 133*a* and nut 136 may together be regarded as a retainer; and the edge 136*a* of the nut is adapted to ride or cam over the shoulder or shoulders, to effect the release. See FIGS. 19-21.

FIGS. 19 and 20 show two shoulders 150 on 124 extending in the path of travel in direction 146 of the convexly curved nut body edge 136*a* at two spaced locations; and FIG. 21 shows edges 136*a* riding over shoulder or shoulders 150. This is further enabled, by allowing part 124 to be temporarily deflected in direction 152, by the smooth camming action, of the interengaging components. See deflection Δ in FIG. 19.

After nut edge 136*a* rides over the shoulder or shoulders 150, and clears them, the element 124 snaps open, away from element 125. See FIG. 18. In effect, the shoulder or shoulders 150 is or are configured to urge said one-element 124 temporarily toward the other element 125 as nut 136 overrides said shoulder or shoulders upon being initially moved in a direction to carry said nut out of said element adjusting position. Shoulder or shoulders 150 initially retain the nut in captivated position preventing inadvertent release of 124 from 125, as during play of the percussion instrument; however, the shoulders allow quick manual release and snap-open action.

Note that the two shoulders are spaced apart and taper toward one another to guide and center one part (i.e. fastener 133*a*) smooth releasing movement, in direction 146 in FIG. 20.

The fasteners and elements 124 and 125 are quickly and easily returned to FIGS. 13 and 15-17 initial positions, for rod clamping.

I claim:

1. A percussion instrument arm adapter, comprising in combination:

a) a support at one end of an arm, the support including rod clamping elements positioned for relative adjustment to clamp a rod, b) structure for effecting said relative adjustment, c) one of the elements swingable relatively away from the other element when at least part of said structure is moved out of element adjusting position, and against a shoulder or shoulders resisting such movement, d) a first hinge operatively connected with the one element to allow swinging thereof toward and away from the other element, e) a second hinge operatively connected with said structure to allow movement of said part out of element adjusting position, f) and including a spring exerting force tending to swing said one element away from the other element.

2. The combination of claim 1 wherein the one element and said structure have interengaged relation prior to movement of said part out of said element adjusting position.

3. The combination of claim 2 wherein said part includes a threaded adjuster shaft, and an adjusting nut engaging said shaft and projecting away from said one element in said adjusting position.

4. The combination of claim 1 wherein said part includes a threaded adjuster shaft, and an adjusting nut engaging said shaft and projecting away from said one element in said adjusting position, said nut being a wing nut.

5. The combination of claim 1 wherein said shoulder is on the one element and extends in the path of movement of said one part.

6. The combination of claim 1 including a second combination as defined in a), b) and c) of claim 1, the second combination being at the opposite end of the arm.

7. A percussion instrument arm adapter, comprising in combination:

a) a support at one end of an arm, the support including rod clamping elements positioned for relative adjustment to clamp a rod, b) structure for effecting said relative adjustment, c) one of the elements swingable relatively away from the other element when at least part of said structure is moved out of element adjusting position, and against a shoulder or shoulders resisting such movement, d) a first hinge operatively connected with the one element to allow swinging thereof toward and away from the other element, e) and including a second hinge operatively connected with said structure to allow movement of said part out of element adjusting position, f) said one element and said structure having interengaged relation prior to movement of said part out of said element adjusting position, g) and wherein said part and said one element have tongue and groove interengaged relation prior to movement of said part out of said element adjusting relation.

8. The combination of claim 7 including a spring exerting force tending to swing said one element away from the other element.

9. A percussion instrument arm adapter, comprising in combination:

a) a support at one end of an arm, the support including rod clamping elements positioned for relative adjustment to clamp a rod, b) structure for effecting said relative adjustment, c) one of the elements swingable relatively away from the other element when at least part of said structure is moved out of element adjusting position, and against a shoulder or shoulders resisting such movement, d) and including a first hinge operatively connected with the one element to allow swinging thereof toward and away from the other element, e) and including a spring associated with said first hinge and exerting force tending to swing said one element away from the other element.

10. The combination of claim 9 wherein said shoulder or shoulders is or are on the one element and extending in the path of movement of said one part, said shoulder or shoulders configured to urge said one-element temporarily toward the other element as said part overrides said shoulder or shoulders upon being initially moved in a direction to carry an adjusting nut out of said element adjusting position.

11. A percussion instrument arm adapter, comprising in combination:

a) a support at one end of an arm, the support including rod clamping elements positioned for relative adjustment to clamp a rod, b) structure for effecting said relative adjustment, c) one of the elements swingable relatively away from the other element when at least part of said structure is moved out of element adjusting position, and against a shoulder or shoulders resisting such movement, d) said shoulder being on the one element and extends in the path of movement of said one part, e) and wherein there are two of said shoulders spaced apart and tapering toward one another to guide said one part for smooth releasing and centered movement, f) there being a first hinge operatively connected with the one element, and a second hinge operatively connected with said structure, g) and including a spring exerting force tending to swing said one element away from the other element.

12. A percussion instrument arm adapter, comprising in combination:

a) a support at one end of an arm, the support including rod clamping elements positioned for relative adjustment to clamp a rod, b) structure for effecting said relative adjustment, c) one of the elements swingable relatively away from the other element when at least part of said structure is moved out of element adjusting position, and against a shoulder or shoulders resisting such movement, d) a first hinge operatively connected with the one element to allow swinging thereof toward and away from the other element, e) a spring associated with said first hinge and exerting force tending to swing said one element away from the other element, f) said shoulder is on the one element and extends in the path of movement of said one part, g) and wherein there are two of said shoulders spaced apart and tapering toward one another to guide said one part movement.

* * * * *